US010496020B2

(12) United States Patent
Iguchi

(10) Patent No.: US 10,496,020 B2
(45) Date of Patent: Dec. 3, 2019

(54) FIXING UNIT WITH TEMPERATURE CONTROL AND IMAGE FORMING APPARATUS WITH TEMPERATURE CONTROL

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Ken Iguchi, Numazu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/935,121

(22) Filed: Mar. 26, 2018

(65) Prior Publication Data

US 2019/0294092 A1 Sep. 26, 2019

(51) Int. Cl.
*G03G 15/20* (2006.01)

(52) U.S. Cl.
CPC ..... *G03G 15/2039* (2013.01); *G03G 15/2017* (2013.01)

(58) Field of Classification Search
CPC ..... G03G 15/2039; G03G 15/2032; G03G 15/2035; G03G 15/205
USPC ..... 399/33, 69, 122
See application file for complete search history.

(56) References Cited

U.S. PATENT DOCUMENTS 6,647,218 B2 * 11/2003 Takayama ..... G03G 15/2003 399/33

FOREIGN PATENT DOCUMENTS

| | | |
|---|---|---|
| JP | 2012-194422 | 10/2012 |
| JP | 2015-94886 | 5/2015 |

* cited by examiner

*Primary Examiner* — William J Royer
(74) *Attorney, Agent, or Firm* — Amin, Turocy & Watson LLP

(57) ABSTRACT

According to an embodiment, a fixing unit includes a heater, a fixing member, a press roller, a sensor, a processor, and a memory. The fixing member is heated by heat generated by the heater. The press roller forms a nip portion through which a medium having a fixing target material transferred thereto passes, between the press roller and the fixing member. The sensor measures a temperature of the fixing member. The processor controls the temperature of the fixing member so as to be a target value by acquiring the temperature detected by the sensor in a first period, and also acquires the temperature detected by the sensor in a second period shorter than the first period. The memory records the temperature acquired in the second period.

20 Claims, 11 Drawing Sheets

FIG. 13

| |
|---|
| 150°C |
| 147°C |
| 147°C |
| 144°C |
| 153°C |
| 148°C |
| 165°C |
| 136°C |
| 151°C |
| 149°C |

FIXING UNIT WITH TEMPERATURE CONTROL AND IMAGE FORMING APPARATUS WITH TEMPERATURE CONTROL

FIELD

Embodiments described herein relate generally to a fixing unit, an image forming apparatus, and methods associated therewith.

BACKGROUND

An image forming apparatus using an electrophotographic system such as a multi-functional peripheral has a fixing unit including a heating device. The fixing unit controls a heat source in accordance with a temperature detected by a temperature detector such as a thermistor. The fixing unit is unitized and installed inside the image forming apparatus such as the multi-functional peripheral. The fixing unit is typically a heavy unit. Consequently, due to vibrations, an extremely heavy load is applied to a connector serving as a harness connecting portion connected to the image forming apparatus, thereby causing a possibility of trouble.

In a fixing process, the fixing unit performs temperature control for controlling a preset fixing temperature, based on the temperature detected by the temperature detector. In a usual fixing process, the fixing unit performs the temperature control by averaging detected temperatures so as to remove noise output by the temperature detector. Therefore, the fixing unit in the related art has a problem in that a sudden abnormal change in the temperature cannot be detected.

In a fixing process, the fixing device performs temperature control for controlling a preset fixing temperature, based on the temperature detected by the temperature detector. In a usual fixing process, the fixing device performs the temperature control by averaging detected temperatures so as to remove noise output by the temperature detector. Therefore, the fixing device in the related art has a problem in that a sudden abnormal change in the temperature cannot be detected.

DESCRIPTION OF THE DRAWINGS

FIG. 13 is a view illustrating an example of abnormality detecting temperature values stored in an abnormality detecting buffer in the abnormality detection process of the fixing unit.

DETAILED DESCRIPTION

According to an embodiment, a fixing unit includes a heater, a fixing member, a press roller, a sensor, a processor, and a memory. The fixing member is heated by heat generated by the heater. The press roller forms, between the press roller and the fixing member a nip portion through which a medium having a fixing target material transferred thereto passes. The sensor measures temperature of the fixing member. The processor acquires the temperature detected by the sensor in a first period, controls the temperature of the fixing member so as to be a target value, and also acquires the temperature detected by the sensor in a second period which is shorter than the first period. The memory records the temperature acquired in the second period.

Hereinafter, an embodiment will be described with reference to the drawings.

Figure 1:
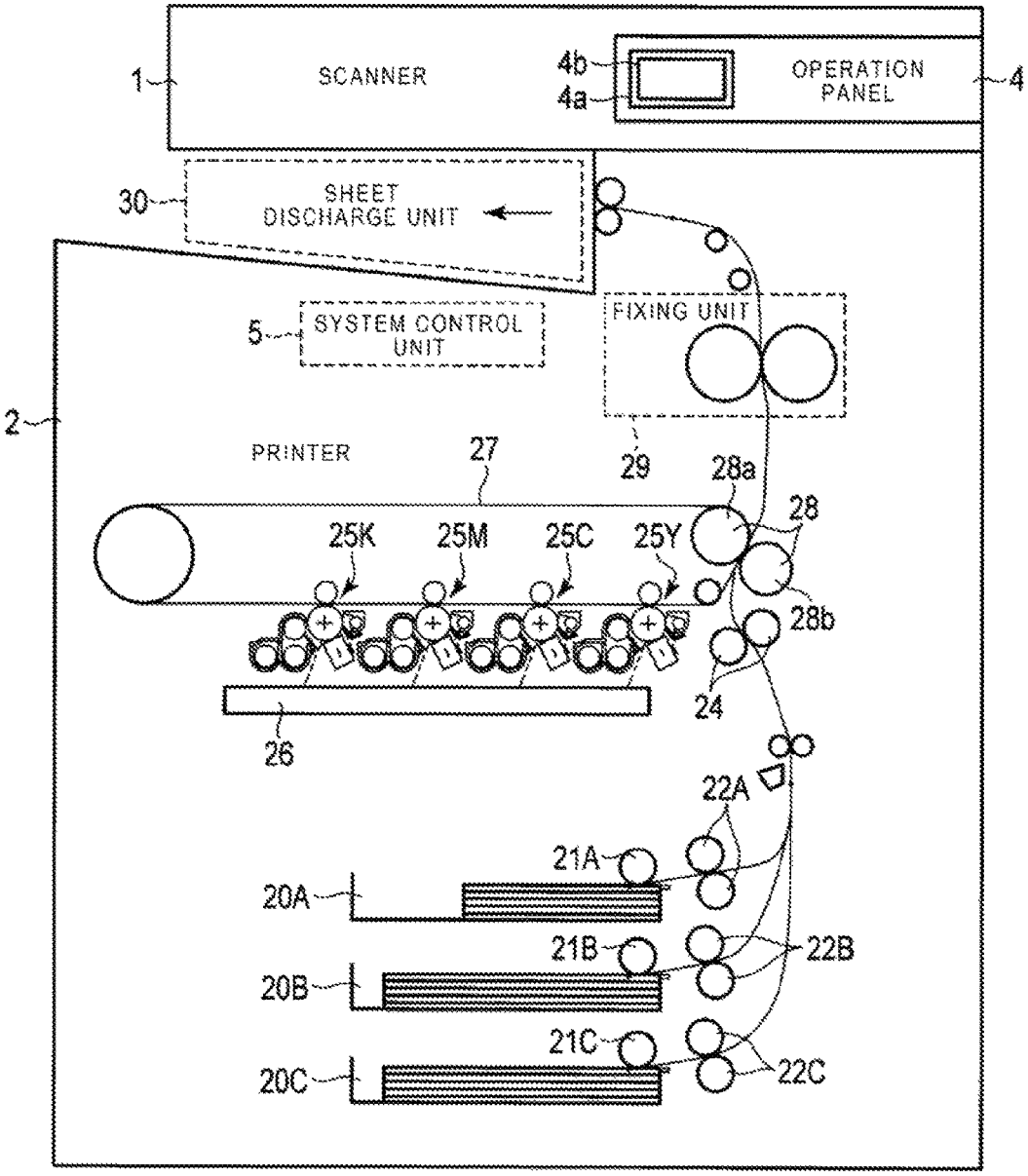
FIG. 1 is a sectional view schematically illustrating a configuration example of a multi-functional peripheral according to an embodiment.

FIG. 1 is a sectional view schematically illustrating a configuration example of a multi-functional peripheral according to the embodiment.

As illustrated in FIG. 1, the multi-functional peripheral (MFP) according to the embodiment described herein includes a scanner 1, a printer 2, an operation panel 4, and a system control unit 5.

The scanner 1 is a device which reads an image of an original document, and converts the image into image data. For example, the scanner 1 is configured to include a CCD line sensor which converts the image on a reading surface of the original document into the image data. The scanner 1 may scan the original document placed on original document table glass, or may read the image of the original document conveyed by an auto document feeder (ADF). The scanner 1 is controlled by the system control unit 5. The scanner 1 outputs the image data of the original document to the system control unit 5.

The printer 2 forms the image on a sheet serving as a medium (an image forming medium or a printing medium). The printer 2 is an electrophotographic image forming apparatus for forming the image by using toner serving as an image forming material. In a configuration example illustrated in FIG. 1, the printer 2 has a color printing function to print a color image on the sheet and a monochrome printing function to print a monochrome (for example, black) image on the sheet. The printer 2 forms the color image by using toners having a plurality of colors (for example, three colors of yellow (Y), cyan (C), and magenta (M)). In addition, the printer 2 forms the monochrome image by using a monochrome (for example, black) toner.

The printer 2 has sheet feeding cassettes 20 (20A, 20B, and 20C). The sheet feeding cassette 20 supplies a printing medium such as sheets or envelopes on which the image is printed. In addition, the printer 2 may have a manual feeding tray as a sheet feeding unit for supplying the printing medium. For example, each of the sheet feeding cassettes 20A, 20B, and 20C in a detachable state is disposed in a lower portion of a main body of the multi-functional peripheral. These sheet feeding cassettes 20A, 20B, and 20C accommodate the printing medium having respectively preset types (for example, a size, sheet quality, and a thickness).

The sheet feeding cassettes 20A, 20B, and 20C have pickup rollers 21 (21A, 21B, and 21C), respectively. The pickup rollers 21A, 21B, and 21C pick up the printing medium one by one from the respective sheet feeding cassettes 20A, 20B, and 20C. The pickup rollers 21A, 21B, and 21C supply the picked-up printing medium to a conveyance path (conveyance unit) 22 configured to include a plurality of conveyance rollers 22A, 22B, and 22C. The number of the sheet feeding cassettes and the pickup rollers which serve as a sheet feeding unit is not limited to three.

The conveyance unit 22 conveys the printing medium inside the printer 2. The conveyance unit 22 conveys the printing medium supplied by the pickup rollers 21A, 21B, and 21C to a registration roller 24. At the timing of transferring the image from an intermediate transfer belt 27 to the printing medium, the registration roller 24 conveys the printing medium to a transfer position of the printing medium.

Image forming units 25 (25Y, 25M, 25C, and 25K), an exposure unit 26, the intermediate transfer belt 27, and a transfer unit 28 form an image. The image forming units 25 (25Y, 25M, 25C, and 25K) form the image to be transferred to the printing medium. In a configuration example illustrated in FIG. 1, the image forming unit 25Y forms the image with yellow toner. The image forming unit 25M forms the image with magenta toner. The image forming unit 25C forms the image with cyan toner. The image forming unit 25K forms the image with black toner. The image forming units 25 (25Y, 25M, 25C, and 25K) superimposedly transfer the images having respective colors on the intermediate transfer belt 27. In this manner, the color image is formed on the intermediate transfer belt 27.

The exposure unit 26 forms an electrostatic latent image on a photoconductive drum (image carrier) of each of the image forming units 25 (25Y, 25M, 25C, and 25K) by using laser light. The exposure unit 26 irradiates the photoconductive drum with the laser light controlled in accordance with the image data via an optical system such as a polygon mirror. The laser light from the exposure unit 26 forms the electrostatic latent image on a surface of each photoconductive drum. The exposure unit 26 controls the laser light in accordance with a control signal output from the system control unit 5. The electrostatic latent image formed in each photoconductive drum is the image to be developed using the toner of each color.

Each of the image forming units 25 (25Y, 25M, 25C, and 25K) develops the electrostatic latent image formed on each photoconductive drum with the toner of each color. Each of the image forming units 25 (25Y, 25M, 25C, and 25K) forms a toner image as a visible image on the photoconductive drum. The intermediate transfer belt 27 is an intermediate transfer member. Each of the image forming units 25 (25Y, 25M, 25C, and 25K) transfers (primarily transfers) the toner image formed on the photoconductive drum onto the intermediate transfer belt 27. Each of the image forming units 25 (25Y, 25M, 25C, and 25K) applies a transfer bias to the toner image at a primary transfer position. The toner image on each photoconductive drum is transferred to the intermediate transfer belt 27 by the transfer bias at each primary transfer position.

For example, when the monochrome image is formed, the image forming unit 25K transfers (primarily transfers) the toner image (visible image) developed with the black (monochrome) toner onto the intermediate transfer belt 27. As a result, the intermediate transfer belt 27 holds the monochrome image formed with the black (monochrome) toner.

In addition, when the color image is formed, each of the image forming units 25Y, 25M, 25C, and 25K superimposedly transfers (primarily transfer) the toner image (visible image) developed with the toner of each color (yellow, magenta, cyan, and black) onto the intermediate transfer belt 27. As a result, the intermediate transfer belt 27 holds the color image in which the toner images having respective colors overlap each other.

The transfer unit 28 transfers the toner image formed on the intermediate transfer belt 27 to the printing medium such as the sheet or the envelope at a secondary transfer position. The secondary transfer position means a position where the toner image formed on the intermediate transfer belt 27 is to be transferred to the printing medium. The secondary transfer position means a position where a support roller 28*a* and a secondary transfer roller 28*b* face each other. The transfer unit 28 applies the transfer bias controlled by a transfer current to the secondary transfer position. The transfer unit 28 transfers the toner image formed on the intermediate transfer belt 27 (a decolorized toner image or a normal toner image) to the printing medium by using the transfer bias. The system control unit 5 controls the transfer current used for a secondary transfer process. For example, the system control unit 5 may control each of the transfer current when the decolorized toner image is transferred and the transfer current when the normal toner image is transferred.

A fixing unit 29 fixes the toner to the printing medium such as the sheet or the envelope. The fixing unit 29 applies heat to the printing medium to which the toner is transferred in a pressurized state, in order to perform a fixing process of fixing the toner image onto the sheet. The system control unit 5 controls the fixing unit 29 to have a fixing temperature when a fixing process is performed to fix the toner image onto the printing medium. The fixing unit 29 controlled to have the fixing temperature pressurizes and heats the printing medium having the toner image transferred by the transfer unit 28 at the fixing temperature. In this manner, the fixing unit 29 fixes the toner image onto the printing medium. In addition, the fixing unit 29 conveys the printing medium subjected to the fixing process to a sheet discharge unit 30. The sheet discharge unit 30 discharges the sheet subjected to the fixing process by the fixing unit 29 to a predetermined position outside the printer 2.

A configuration of the fixing unit 29 will be described in detail later. In addition, a configuration for forming the toner image on the printing medium such as the sheet or the envelope is not limited to the above-described configuration. The image forming apparatus according to the embodiment described herein may have any configuration where the printing medium serving as a target of the fixing process is supplied to the fixing unit 29.

The operation panel 4 is a user interface. The operation panel 4 has various buttons and a display unit 4*a* provided with a touch panel 4*b*. The system control unit 5 controls content displayed on the display unit 4*a* of the operation panel 4. In addition, the operation panel 4 outputs information input from the touch panel 4*b* of the display unit 4*a* or the buttons to the system control unit 5. A user designates an operation mode on the operation panel 4, or inputs information such as setting information.

Next, a configuration of the fixing unit (fixing device) 29 disposed in the multi-functional peripheral according to the embodiment will be described.

Figure 2:
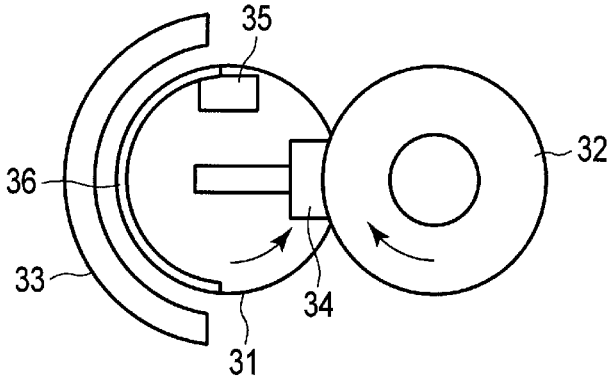
FIG. 2 is a sectional view illustrating a configuration example of a fixing unit.

FIG. 2 is a sectional view illustrating a configuration example of the fixing unit 29 according to the embodiment.

In the configuration example illustrated in FIG. 2, the fixing unit 29 has a fixing belt (fixing member) 31, a press roller (pressure contact member) 32, a heating unit (heater) 33, a fixing pad 34, a temperature detector (sensor) 35, and a magnetic shunt metal 36. The fixing unit 29 is formed as one unit (fixing device). In addition, the fixing unit 29 has a connector serving as a harness connecting portion, and is connected to the multi-functional peripheral via the connector.

The fixing belt 31 is an endless belt. The fixing belt 31 is heated by the heat supplied from the heating unit 33. The fixing belt 31 is formed of a material which has high thermal conductivity and which is easily deformable. For example, the fixing belt 31 includes a metal conductor and an elastic member. The fixing belt 31 may be the endless belt obtained in such a way that a metal layer formed of nickel, a solid rubber layer formed of silicone rubber, and a release layer formed of polytetrafluoroethylene (PFA) tube are sequentially stacked one on another.

The press roller 32 comes into contact with the fixing belt 31. For example, the press roller 32 has a rubber layer around a cored bar. For example, the rubber layer serving as a surface of the press roller 32 is formed of silicone rubber or fluorine rubber.

The press roller 32 is moved in a direction where the press roller 32 comes into contact with or is separated from the fixing belt 31, by a contact and separation mechanism (to be described later). A nip portion is formed between the fixing belt 31 and the press roller 32. The printing medium is subjected to the fixing process by passing through the nip portion between the fixing belt 31 and the press roller 32. Nipping pressure which is a pressure of the press roller 32 coming into contact with the fixing belt 31 is adjusted by the contact and separation mechanism.

An electromagnetic induction heater or a halogen lamp heater may be disposed in the press roller 32. The heater is disposed in the press roller 32, thereby further increasing a first copy output time (FCOT).

The heating unit 33, the fixing pad 34, the temperature detector 35, and the magnetic shunt metal 36 are disposed in the vicinity of the fixing belt 31. In a configuration example illustrated in FIG. 2, the heating unit 33 is disposed on an outer periphery of the fixing belt 31. In addition, the fixing pad 34, the temperature detector 35, and the magnetic shunt metal 36 are disposed inside the endless fixing belt 31.

The heating unit 33 heats the fixing belt 31. The heating unit 33 may be capable of controlling the temperature. For example, the heating unit 33 may be an induction heating (IH) type heater or a heater lamp such as a halogen lamp. In the embodiment described herein, description will be made on the assumption that the heating unit 33 is configured to include an IH coil. The IH type heating unit 33 has a coil configured to include a magnetic core and a conductive wire wound around the magnetic core. In the configuration example illustrated in FIG. 2, the heating unit 33 is disposed on the outer periphery of the fixing belt 31, and the magnetic shunt metal 36 is disposed inside the fixing belt 31 facing the heating unit 33.

For example, the IH type heating unit 33 is configured to include a plurality of coils as a plurality of heaters. The plurality of coils configuring the heating unit 33 are arranged at a plurality of locations in a width direction of the fixing belt 31. In the configuration example, the fixing belt 31 may be divided in the width direction into three regions of a central portion, a right side portion, and a left side portion, and a first coil, a second coil, and a third coil may be arranged in the regions, respectively. The first coil heats the central portion including the center in the width direction of the fixing belt 31. The second and third coils heat both side portions which does not include the center in the width direction of the fixing belt 31.

The fixing pad 34 is disposed at a position where the fixing belt 31 comes into contact with the press roller 32. The fixing pad 34 is formed of an elastic body deformed in accordance with the press roller 32 which comes into contact with and is separated from the fixing pad 34. For example, the fixing pad 34 is formed of foam rubber (sponge). The fixing belt 31 is deformed along with the fixing pad 34, and forms the nip portion between the fixing belt 31 and the press roller 32 which comes into contact with the fixing pad 34.

The temperature detector 35 is a sensor which detects the temperature of the fixing belt 31 heated by the heating unit 33. For example, the temperature detector 35 is the sensor such as a thermistor. The temperature detector 35 may be capable of measuring the temperature of the fixing belt 31, or may be a thermopile type sensor which detects infrared rays in a non-contact manner. In addition, a plurality of temperature detectors 35 may be set in order to detect the temperature at a plurality of locations in the fixing belt 31. For example, as the temperature detector 35, a first temperature sensor for detecting the temperature of the central portion and a second temperature sensor for detecting the temperature of the side portion may be arranged for the fixing belt 31.

Next, a configuration of the control system of the multi-functional peripheral will be described.

Figure 3:
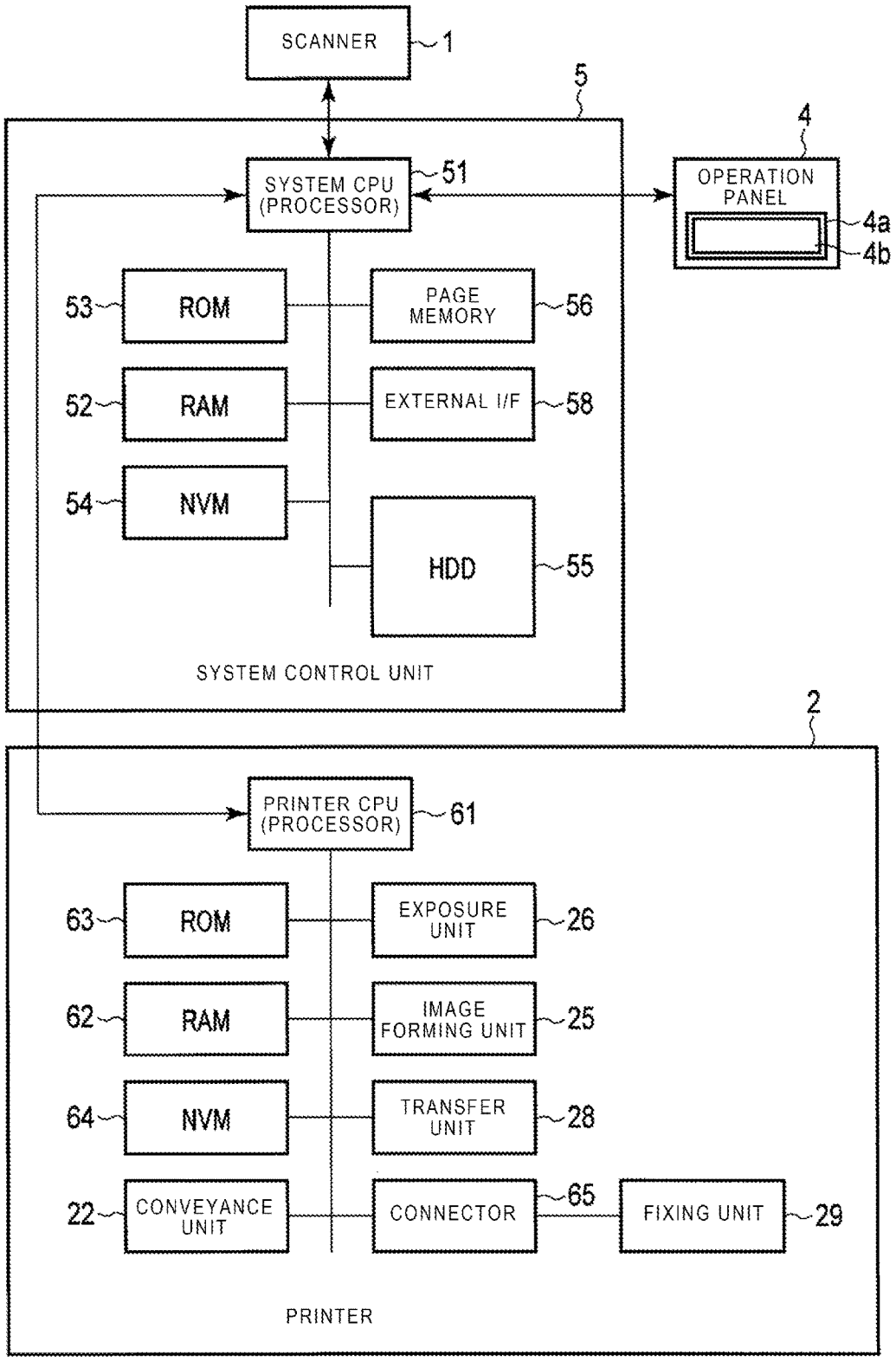
FIG. 3 is a block diagram schematically illustrating a configuration example of a control system in the multi-functional peripheral.

FIG. 3 is a block diagram schematically illustrating a configuration example of the control system in the multi-functional peripheral according to the embodiment.

In the configuration example illustrated in FIG. 3, the system control unit 5 includes a system CPU (processor) 51, a RAM 52, a ROM 53, a nonvolatile memory (NVM) 54, an HDD 55, a page memory 56, and an external interface (I/F) 58.

The system CPU 51 integrally controls the entire body and each unit of the whole multi-functional peripheral. The system CPU 51 is a processor which realizes processes by executing a program. The system CPU 51 is connected to each unit in the device via a system bus. The system CPU 51 is connected to not only each unit inside the system control unit 5, but also the scanner 1, the printer 2, the operation panel 4 via the system bus. The system CPU 51 outputs an operation instruction to each of the scanner 1, the printer 2, and the operation panel 4, or acquires various information items from the unit by using bidirectional communication with the unit. In addition, the system CPU 51 inputs information indicating a detection signal and an operation state of various sensors installed in each unit inside the printer 2.

The RAM 52 is configured to include a volatile memory. The RAM 52 functions as a working memory or a buffer memory. The ROM 53 is a non-rewritable and nonvolatile memory for storing a program and control data. The system CPU 51 realizes various processes by executing the program stored in the ROM 53 (or the nonvolatile memory 54 and the HDD 55) while using the RAM 52. For example, the system CPU 51 functions as printing means and printing prohibition means by executing the program.

The nonvolatile memory (NVM) 54 is a rewritable and nonvolatile memory. The NVM 54 stores a control program executed by the system CPU 51 and control data. In addition, the NVM 54 stores various setting information items and processing conditions. For example, the NVM 54 stores the setting information for each sheet feeding cassette (sheet feeding unit). For example, the setting information for the sheet feeding cassette includes flag information indicating whether or not the sheet feeding cassette is a cassette dedicated to the black color.

The hard disk drive (HDD) 55 is a large-capacity storage device. The HDD 55 stores image data and various types of operation history information. In addition, the HDD 55 may store the control program and the control data, or may store the setting information and the processing conditions.

The page memory 56 is a memory for developing the image data serving as a processing target. For example, when a copying process is performed, the page memory 56 stores the image data obtained by the scanner 1 which reads the image and performs image processing on the image for scanning.

The external interface (I/F) 58 is an interface for communicating with an external device. For example, the external interface 58 receives print data in accordance with a print request output from the external device. The external interface 58 may be an interface for communicating with the external device such as a client terminal or a management server. For example, the external interface 58 may be locally connected to the external device, or may be a network interface for communicating with the external device via a network.

Next, a configuration example of the control system in the printer 2 will be described.

In the configuration example illustrated in FIG. 3, as the configuration of the control system, the printer 2 has a printer CPU (processor) 61, a RAM 62, a ROM 63, a nonvolatile memory (NVM) 64, and a connector 65.

The printer CPU 61 controls the overall printer 2. The printer CPU 61 is a processor which realizes processing by executing a program. The printer CPU 61 is connected to each unit inside the printer 2 via a system bus. In accordance with an operation instruction output from the system CPU 51, the printer CPU 61 outputs the operation instruction to each unit inside the printer 2, or notifies the system CPU 51 of various information items acquired from each unit.

The RAM 62 is configured to include a volatile memory. The RAM 62 functions as a working memory or a buffer memory. The ROM 63 is a non-rewritable and nonvolatile memory for storing a program and control data. The printer CPU 61 realizes various processes by executing the program stored in the ROM 63 (or the nonvolatile memory 64) while using the RAM 62.

The nonvolatile memory (NVM) 64 is a rewritable and nonvolatile memory. For example, the nonvolatile memory 64 stores a control program and control data which are executed by the printer CPU 61. In addition, the nonvolatile memory 64 may store setting information and processing conditions.

The conveyance unit 22 is connected to the printer CPU 61. The printer CPU 61 controls sheet conveyance inside the printer 2. The printer CPU 61 controls motors for driving the pickup roller 21 and the conveyance unit 22. In accordance with an operation instruction from the system CPU 51, the printer CPU 61 controls driving of a conveyance roller of the conveyance unit 22 inside the printer 2. For example, the printer CPU 61 instructs the pickup roller 21 and the conveyance unit 22 to start sheet feeding in accordance with an instruction to start image formation processing, which is output from the system CPU 51.

The exposure unit 26 is connected to the printer CPU 61. The printer CPU 61 controls the exposure unit 26. The printer CPU 61 causes the exposure unit 26 to form the electrostatic latent image on the photoconductive drum of each of the image forming units 25Y, 25M, 25C, and 25K. For example, the printer CPU 61 controls laser light with which the exposure unit 26 irradiates each photoconductive drum in accordance with the image data supplied from the system control unit 5.

The image forming unit 25 is connected to the printer CPU 61. The printer CPU 61 controls driving of each of the image forming units 25Y, 25M, 25C, and 25K. The printer CPU 61 develops the electrostatic latent image formed on the photoconductive drum of each of the image forming units 25Y, 25M, 25C, and 25K by using the toner of each color.

The transfer unit 28 is connected to the printer CPU 61. The printer CPU 61 controls driving and a transfer current of the transfer unit 28. The printer CPU 61 causes the transfer unit 28 to transfer the toner image transferred to the intermediate transfer belt 27 to the sheet.

The fixing unit 29 is unitized, and has a harness for being electrically connected to the printer 2. The connector 65 connects the harness of the unitized fixing unit 29. The fixing unit 29 is connected to the printer CPU 61 and a power source via the connector 65. The printer CPU 61 controls driving of the fixing unit 29 connected to the printer CPU 61 via the connector 65. For example, the printer CPU 61 controls the heating unit 33 to be turned on and off, and controls driving of the fixing belt 31 and the press roller 32. In addition, the printer CPU 61 has a function to control the contact and separation mechanism by controlling driving of a drive unit 41 (to be described later).

In addition, the printer CPU 61 acquires information indicating the temperature measured by the temperature detector 35 at a preset timing. In the fixing process, the printer CPU 61 acquires the temperature measured by the temperature detector 35 in a sampling period (first period) for temperature control (fixing control). The printer CPU 61 controls the heating unit 33, based on the temperature acquired in the sampling period for temperature control, thereby controlling surface temperature of the fixing belt 31 to be control target temperature. The printer CPU 61 also has a function to acquire the temperature measured by the temperature detector 35 in a sampling period (second period) for detecting abnormality, which is shorter than the sampling period for temperature control.

In the embodiment described herein, the printer CPU 61 performs the control of the fixing unit 29 including the control of processes described later. However, the processes described later may be performed by the system CPU 51 of the system control unit 5. In addition, the processes described later may be performed by the processor disposed inside the fixing unit 29. The processor and the memory for executing the processes described later are disposed inside the fixing unit 29. In this manner, it is possible to realize the fixing unit 29 having a function to realize the processes described later.

Next, a configuration of the contact and separation mechanism in the fixing unit 29 of the multi-functional peripheral according to the embodiment will be described.

Figure 4:
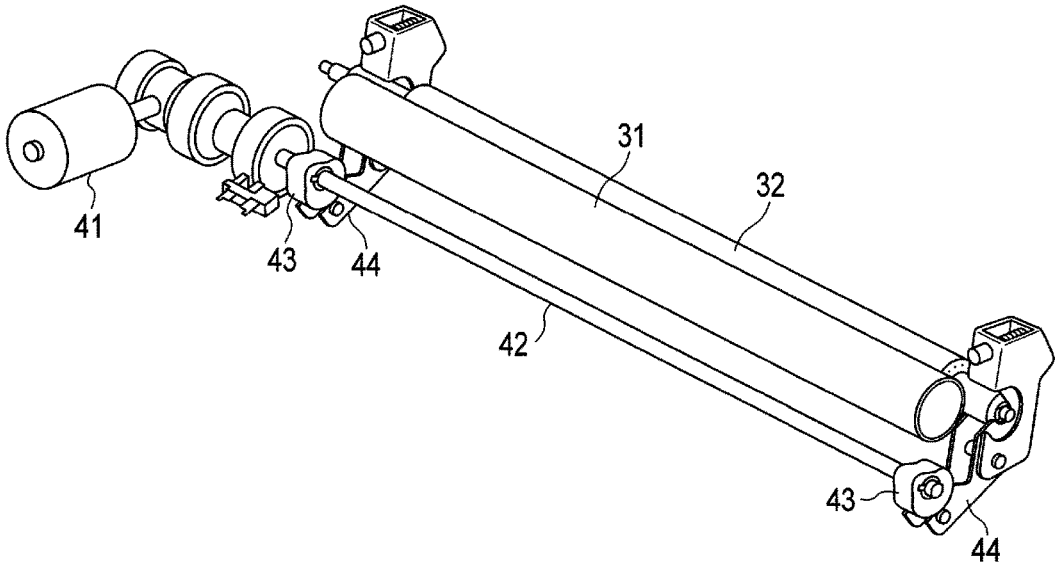
FIG. 4 is a perspective view schematically illustrating a configuration example of the fixing unit.
Figure 5:
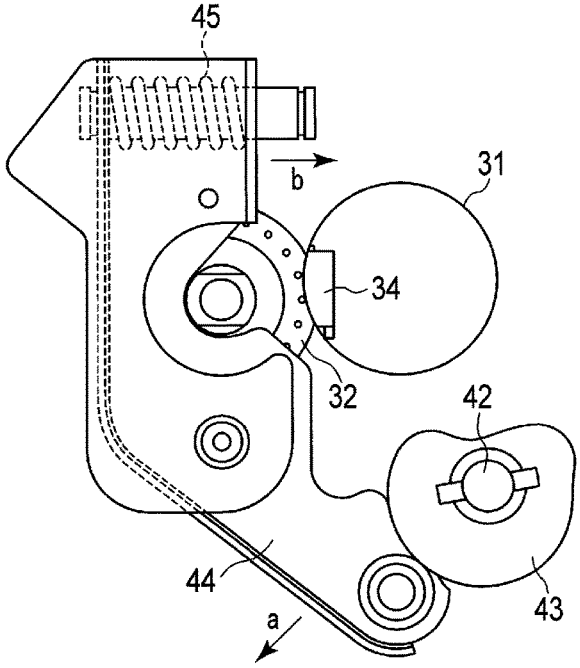
FIG. 5 is a view for describing a configuration example of a contact and separation mechanism in the fixing unit.

FIG. 4 is a perspective view schematically illustrating a configuration example of the overall fixing unit 29. FIG. 5 is a view for describing the configuration example of the contact and separation mechanism by which the press roller 32 is brought into contact with or is separated from the fixing belt 31 in the fixing unit 29.

In the configuration example illustrated in FIGS. 4 and 5, the contact and separation mechanism is configured to include the drive unit (contact and separation motor) 41, a shaft 42, an eccentric cam 43, and a cam follower 44.

The drive unit 41 applies a drive force by which the press roller 32 is brought into contact with or is separated from the fixing belt 31. For example, the drive unit 41 is configured to include a brush motor. The drive unit 41 is driven in accordance with a control instruction output from the system control unit 5. The drive unit 41 is connected to the shaft 42 serving as a rotation axis of the eccentric cam 43 via a plurality of gears. The shaft 42 is rotated along with the rotation of the motor serving as the drive unit 41, thereby rotating the eccentric cam 43 disposed in the shaft 42. The system control unit 5 controls a rotation angle of the eccentric cam 43 by controlling an operation of the drive unit 41.

The eccentric cam 43 has an eccentric shape, and moves the cam follower 44 by rotating around the shaft 42 serving as the rotation axis. The cam follower 44 moves the press roller 32 in a direction where the press roller 32 is brought into contact with or is separated from the fixing belt 31. The cam follower 44 is connected to a spring (elastic body) 45, and is configured to be always in contact with the rotating eccentric cam 43. The cam follower 44 moves along with the rotation of the eccentric cam 43, thereby causing the press roller 32 to move in the direction the press roller 32 is brought into contact with or is separated from the fixing belt 31.

As illustrated in FIG. 4, the eccentric cam 43 and the cam follower 44 are respectively disposed in both ends of the press roller 32. The two eccentric cams 43 disposed in both ends of the press roller 32 have the same shape. In addition, the two cam followers 44 disposed in both ends of the press roller 32 also have the same shape. In each end of the press roller 32, the eccentric cam 43 and the cam follower 44 are disposed so as to come into contact with each other.

The two eccentric cams 43 disposed in both ends of the press roller 32 are connected to each other by the shaft 42. The two eccentric cam 43 (in both ends) are similarly rotated in accordance with the rotation of the shaft 42. That is, the two eccentric cams 43 connected to the shaft 42 rotated by the drive unit 41 are rotated at the same time. The two eccentric cams 43 connected to the shaft 42 are rotated, thereby causing the two cam followers 44 to move both ends of the press roller 32.

In the example illustrated in FIG. 5, if a contact portion with the eccentric cam 43 is pushed in a direction of an arrow a, the cam follower 44 moves the press roller 32 in a direction of an arrow b. In other words, if the eccentric cam 43 moves the contact portion with the cam follower 44 in the direction of the arrow a, the press roller 32 moves in the direction (direction of the arrow b) where the press roller 32 comes into contact with the fixing belt 31. As the eccentric cam 43 moves the cam follower 44 in the direction of the arrow a after the press roller 32 and the fixing belt 31 come into contact with each other, the pressure (nipping pressure) applied to the nip portion between the press roller 32 and the fixing belt 31 increases.

In addition, if the contact portion with the eccentric cam 43 moves in a direction opposite to the arrow a, the cam follower 44 moves the press roller 32 in a direction opposite to the arrow b. In other words, if the eccentric cam 43 moves the cam follower 44 in the direction opposite to the arrow a, the press roller 32 moves in the direction separated from the fixing belt 31. In a state where the press roller 32 and the fixing belt 31 are in contact with each other, as the eccentric cam 43 moves the cam follower 44 in the direction opposite to the arrow a, the nipping pressure decreases. In addition, in a separated state, as the eccentric cam 43 moves the cam follower 44 in the direction opposite to the arrow a, the distance between the press roller 32 and the fixing belt 31 becomes wider.

Next, a relationship between a rotation angle of the eccentric cam 43 and a position of the press roller 32 in the fixing unit 29 will be described.

Figure 6:
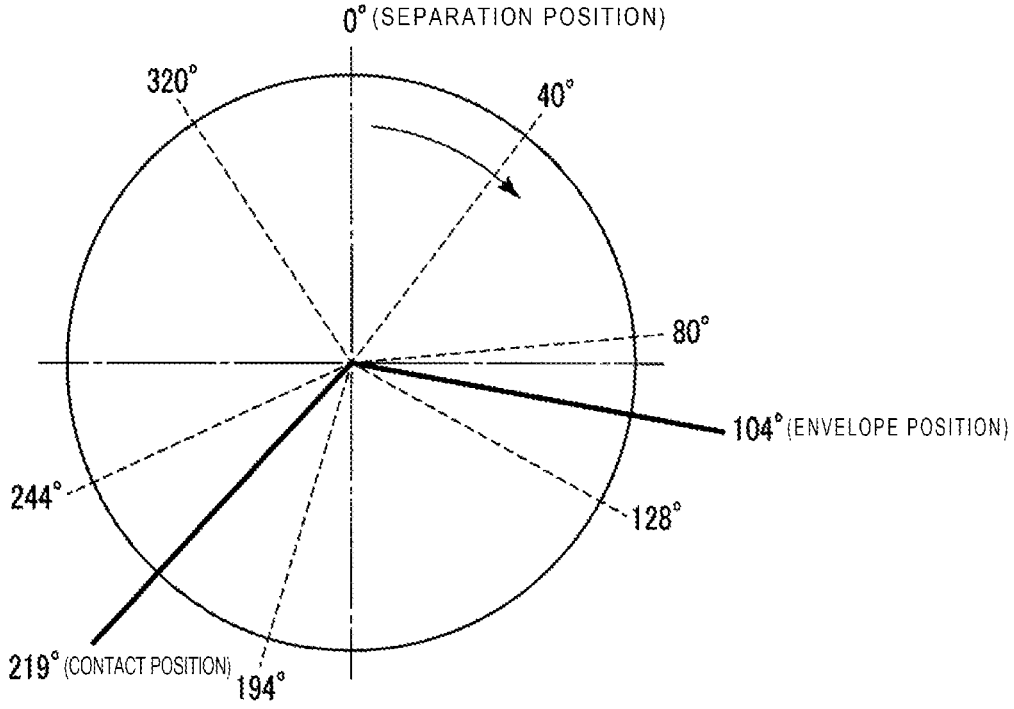
FIG. 6 is a view illustrating an example of a relationship between a rotation angle of an eccentric cam and a position of a press roller in the fixing unit.

FIG. 6 is a view illustrating an example of the relationship between the rotation angle of the eccentric cam 43 and the position of the press roller 32 in the fixing unit 29 according to the embodiment.

The fixing unit 29 causes the heating unit 33 to heat the fixing belt 31 up to the fixing temperature, and causes the printing medium to pass through the nip portion between the fixing belt 31 and the press roller 32. The toner on the printing medium passing through the nip portion is fixed onto the printing medium by the heat and the nipping pressure. The fixing unit 29 adjusts the nip portion by moving the press roller 32 in accordance with the fixing process.

For example, the press roller 32 can set a separation position, a contact position, and an envelope position for the fixing belt 31. The separation position is a position when the press roller 32 and the fixing belt 31 are separated from each other. The contact position is a position when the fixing process is performed on a sheet having a thickness equal to or smaller than a predetermined threshold value (hereinafter, simply referred to as a sheet). The envelope position is a position when the fixing process is performed on an envelope, that is, a sheet having a thickness larger than the predetermined threshold value.

In the example illustrated in FIG. 6, if the rotation angle of the eccentric cam 43 is 320° to 40°, the press roller 32 and the fixing belt 31 are in the separated state. In addition, if the rotation angle of the eccentric cam 43 is 0°, the press roller 32 is located at the separation position with respect to the fixing belt 31. The multi-functional peripheral sets the rotation angle of the eccentric cam 43 to 0° when the press roller 32 is located at the separation position.

In the example illustrated in FIG. 6, if the rotation angle of the eccentric cam 43 is 194° to 244°, the press roller 32 and the fixing belt 31 form the nip portion suitable for the fixing process of the sheet. In addition, when the rotation angle of the eccentric cam 43 is 219°, the press roller 32 is located at the contact position with respect to the fixing belt 31. For example, when the fixing process is performed on the sheet, the eccentric cam 43 is rotated from 0° to 219° in order to move the press roller 32 from the separation position to the contact position.

In the example illustrated in FIG. 6, if the rotation angle of the eccentric cam 43 is 80° to 128°, the press roller 32 and the fixing belt 31 form the nip portion suitable for the fixing process for the envelope. In addition, when the rotation angle of the eccentric cam 43 is 104°, the press roller 32 is located at the envelope position with respect to the fixing belt 31. In addition, when the fixing process is performed on the envelope, the eccentric cam 43 is rotated from 0° to 104° in order to move the press roller 32 from the separation position to the envelope position.

In addition, when the fixing process is completed, the eccentric cam 43 is rotated from 219° or 104° to 0° in order to move the press roller 32 from the contact position or the envelope position to the separation position.

Next, operation control of each unit in the fixing unit 29 will be described.

Figure 7:
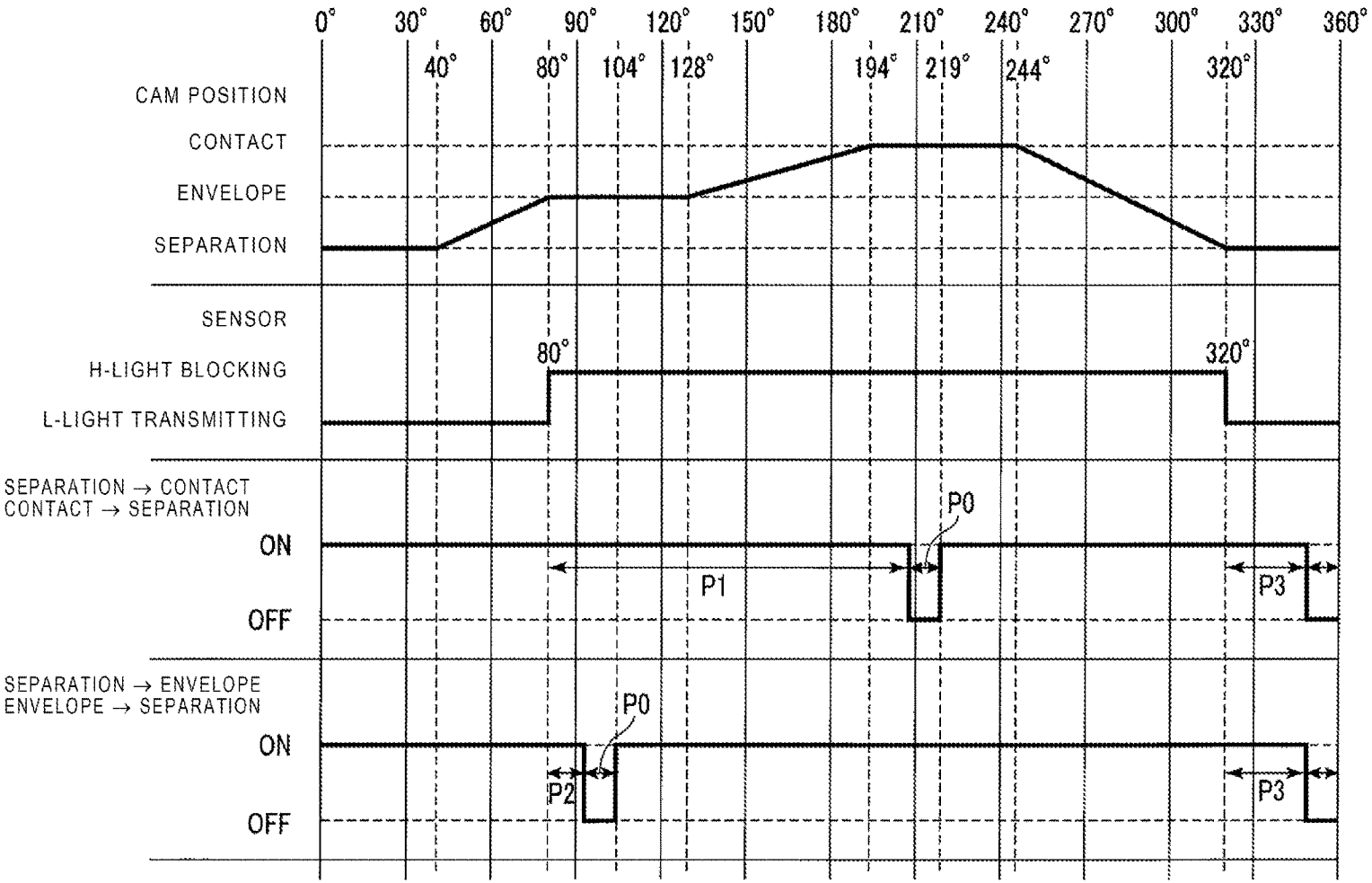
FIG. 7 is a timing chart for describing an operation of each unit in a fixing process of the fixing unit.
Figure 8:
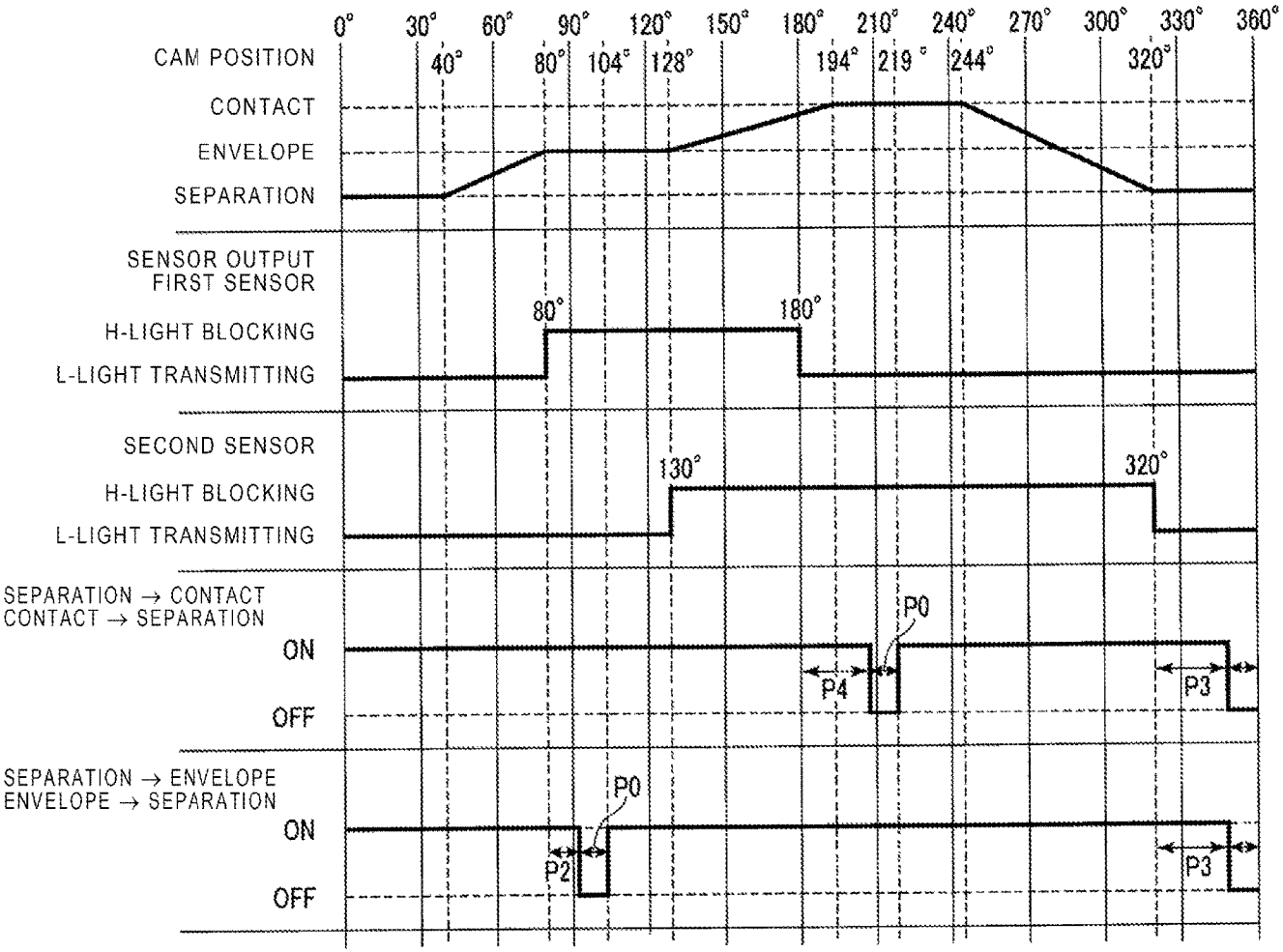
FIG. 8 is a timing chart for describing an operation of each unit in a fixing process of the fixing unit.

FIGS. 7 and 8 are timing charts for describing the operation of the units associated with the fixing process in the fixing unit 29 of the multi-functional peripheral according to the embodiment.

In the example illustrated in FIG. 7, the fixing unit 29 has a sensor which detects that the position of the eccentric cam 43 is between 80° and 320°. In addition, in the example illustrated in FIG. 8, the fixing unit 29 has a first sensor which detects that the position of the eccentric cam 43 is between 80° and 180°, and a second sensor which detects that the position of the eccentric cam 43 is between 130° and 320°. In the charts illustrated in FIGS. 7 and 8, in an initial state, the eccentric cam 43 is located at the separation position where the rotation angle is 0°.

If the fixing process starts, the printer CPU 61 turns on the contact and separation motor serving as the drive unit 41, thereby rotating the eccentric cam 43. If the motor of the drive unit 41 is turned on, the eccentric cam 43 starts to be rotated. In addition, the eccentric cam 43 is braked in rotation if the motor of the drive unit 41 is turned off. In this manner, the eccentric cam 43 stops when a stop time P0 elapses after the motor of the drive unit 41 is turned off.

In the example illustrated in FIG. 7, if the press roller 32 is located at the contact position (when the fixing process is performed on the sheet), when a first time P1 elapses after the rotation angle of the eccentric cam 43 becomes 80°, the motor of the drive unit 41 is turned off. In such a manner that the motor of the drive unit 41 is turned off when the first time P1 elapses after the rotation angle becomes 80°, the eccentric cam 43 stops at the rotation angle of 219° which represents the contact position.

In addition, in the example illustrated in FIG. 8, if the press roller 32 is located at the contact position (when the fixing process is performed on the sheet), the motor of the drive unit 41 is turned off when a fourth time P4 elapses after the rotation angle of the eccentric cam 43 becomes 180°. In such a manner that the motor of the drive unit 41 is turned off when the fourth time P4 elapses after the rotation angle becomes 180°, the eccentric cam 43 stops at the rotation angle of 219° which represents the contact position. The fixing unit 29 performs the fixing process on the sheet in a state where the press roller 32 is located at the contact position.

In addition, if the press roller 32 is located at the envelope position (if the fixing process is performed on the envelope), the motor of the drive unit 41 is turned off when the second time P2 elapses after the rotation angle of the eccentric cam 43 becomes 80°. When the stop time P0 elapses after the motor of the drive unit 41 is turned off at the rotation angle of 80°, the eccentric cam 43 stops at the rotation angle of 104° which represents the envelope position. The fixing process is performed on the envelope at the envelope position.

In addition, when the press roller 32 is located at the separation position, the motor of the drive unit 41 is turned off when a third time P3 elapses after the rotation angle of the eccentric cam 43 becomes 320°. When the stop time P0 elapses after the motor of the drive unit 41 is turned off at the rotation angle of 320°, the eccentric cam 43 stops at the rotation angle of 0 (360°) which represents the envelope position.

Next, an operation of the temperature measurement in the fixing process and the abnormality detection process of the fixing unit 29 will be described.

Figure 9:
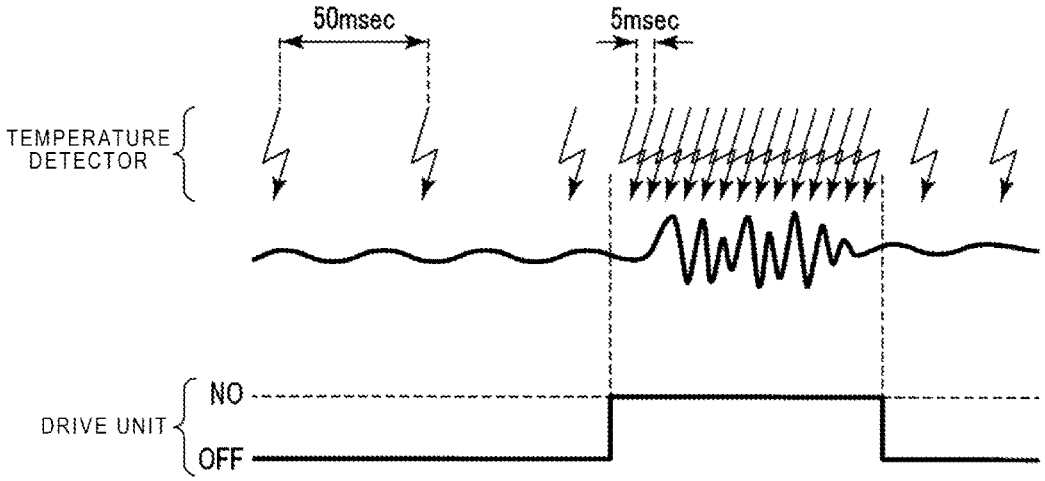
FIG. 9 is a view for describing an operation example of temperature measurement in a fixing process and an abnormality detection process of the fixing unit.

FIG. 9 is a view for describing an operation example of the temperature measurement in the fixing process and the abnormality detection process of the fixing unit 29.

In the fixing process, the printer CPU 61 acquires information indicating the temperature measured by the temperature detector 35 at the set measurement interval (sampling period for temperature control (first period)). In addition, in the fixing process, the printer CPU 61 acquires the temperature information obtained by averaging the temperatures measured at a predetermined measurement interval in order to perform the temperature control by using stable temperature information. For example, the printer CPU 61 adopts as the averaged temperature information the average values of the temperature values obtained by eliminating the maximum value and the minimum value from a plurality of temperature values acquired in the sampling period for temperature control at each predetermined time.

As described above, the fixing unit 29 is unitized, and the harness of the electrical system is connected to the main body of the multi-functional peripheral via the connector 65. If the connection in the connector 65 is loose, the connection state of the fixing unit 29 in the connector 65 becomes unstable due to vibrations. For example, if the connection state in the connector 65 becomes unstable due to the vibrations, the fixing unit 29 may have suddenly fluctuating temperature. Therefore, the fixing unit 29 according to the embodiment described herein performs an abnormality detection process for detecting a sudden abnormal change in the temperature.

That is, the fixing unit 29 according to the embodiment described herein performs the abnormality detection process for detecting a sudden temperature change in addition to the temperature measurement in the fixing process. In the abnormality detection process, the fixing unit 29 measures the temperature in the sampling period for abnormality detection (second period) which is shorter than the sampling period (sampling period for temperature control) used for the temperature measurement in the fixing process. For example, in the example illustrated in FIG. 9, the sampling period for temperature control is 50 msec, and the sampling period for abnormality detection is 5 msec.

In addition, if it is assumed that the connection state becomes unstable due to the vibrations, the abnormality detection process may be performed during a period in which the vibrations are generated. For example, the fixing unit 29 using the above-described mechanism is greatly vibrated when the press roller 32 is brought into contact with or is separated from the fixing belt 31. Therefore, the fixing unit 29 according to the embodiment described herein performs the abnormality detection process while the operation is performed in which the press roller 32 is brought into contact with or is separated from the fixing belt 31.

According to the above-described mechanism, it is expected that the fixing unit 29 is greatly vibrated when the press roller 32 is separated from the fixing belt 31. Therefore, the abnormality detection process may be performed during the operation of the press roller 32 separating from the fixing belt 31. In the multi-functional peripheral in which the vibrations are generated due to the operation other than contact or separation, the abnormality detection process may be performed during a period in which the vibrations are generated.

Next, an operation including the abnormality detection process in the fixing unit 29 of the multi-functional peripheral will be described.

First, a process of setting the timing of measuring the temperature in the fixing unit 29 (sampling period setting process) will be described.

Figure 10:
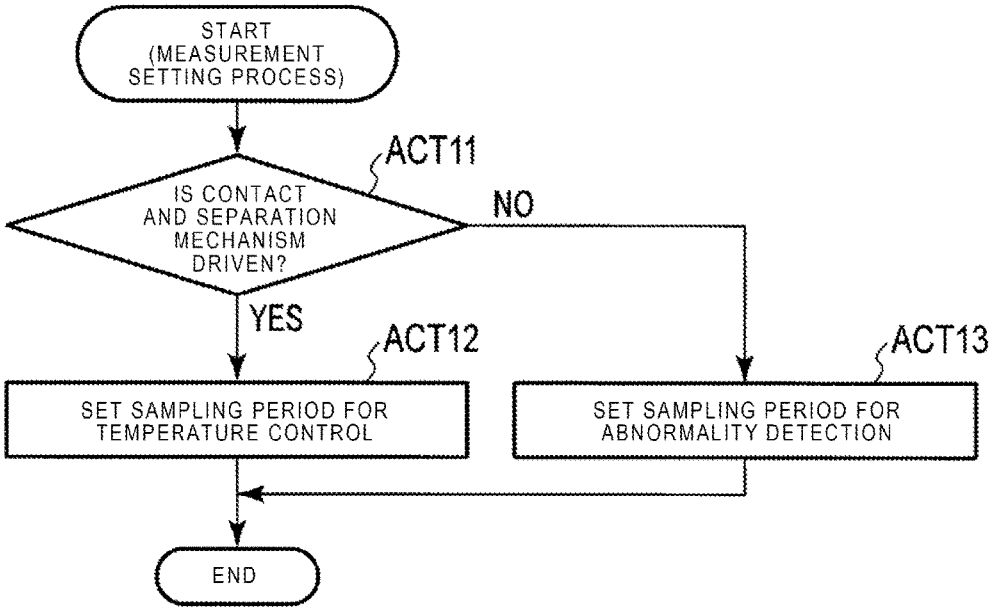
FIG. 10 is a flowchart for describing a setting process (measurement setting process) of a sampling period for setting the timing of measuring temperature of the fixing unit.

FIG. 10 is a flowchart for describing the sampling period setting process (measurement setting process) for setting the timing of measuring the temperature in the fixing unit 29.

Here, the printer CPU 61 performs the abnormality detection process while the drive unit (contact and separation motor) 41 is driven in the contact and separation mechanism. In this case, the printer CPU 61 sets the timing (sampling period) of acquiring the temperature measured by the temperature detector 35 in accordance with the driving of the drive unit (contact and separation motor) 41 in the contact and separation mechanism. That is, the printer CPU 61 monitors whether or not the drive unit 41 is driven during the period in which the temperature control of the fixing unit 29 is performed (ACT11).

When it is determined that the drive unit 41 is not driven (ACT11, NO), the printer CPU 61 sets the timing of acquiring the temperature from the temperature detector 35 to the sampling period for temperature control (the first period) (ACT12). For example, if the sampling period for temperature control is 50 msec, the printer CPU 61 sets the timing so as to acquire the temperature measured by the temperature detector 35 at a period of 50 msec.

When it is determined that the drive unit 41 is driven (ACT11, YES), the printer CPU 61 sets the timing of acquiring the temperature from the temperature detector 35 to the sampling period for abnormality detection (the second period) (ACT13). For example, if the sampling period for abnormality detection is 5 msec, the printer CPU 61 sets the timing so as to acquire the temperature measured by the temperature detector 35 at a period of 5 msec.

As described above, the multi-functional peripheral sets the sampling period for acquiring the temperature information depending on whether or not to perform the abnormality detection process. In the embodiment described herein, on the assumption that the vibrations are generated during the contact operation or the separation operation, the fixing unit 29 performs the abnormality detection process during the contact operation or the separation operation. Therefore, the multi-functional peripheral sets the sampling period of the temperature depending on whether or not the drive unit 41 of the contact and separation mechanism is driven. In this manner, the multi-functional peripheral can perform the abnormality detection process during a period when the vibrations are generated due to the operation of the fixing unit 29 which comes into contact with or is separated from the press roller 32.

Next, the sampling process (temperature measurement process) of the temperature in the fixing unit 29 will be described.

Figure 11:
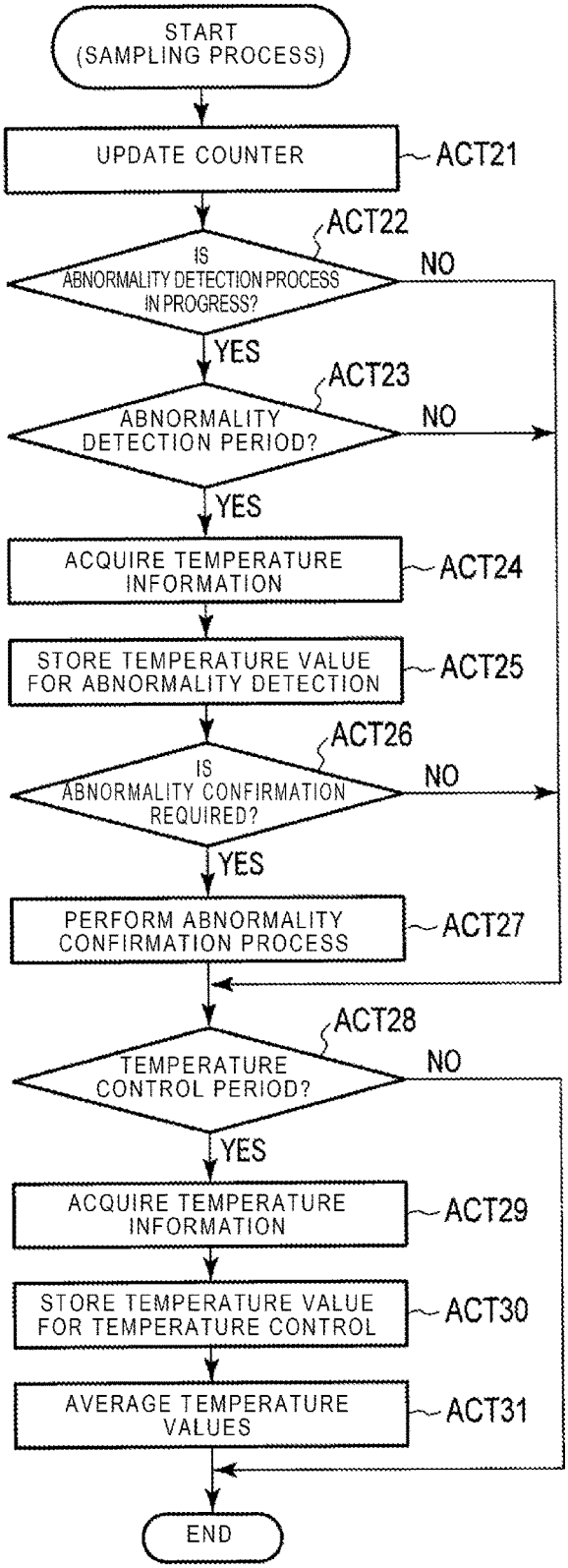
FIG. 11 is a flowchart for describing a sampling process (temperature measurement process) for measuring the temperature of the fixing unit.

FIG. 11 is a flowchart for describing the sampling process (temperature measurement process) of the temperature in the fixing unit 29.

Figure 12:
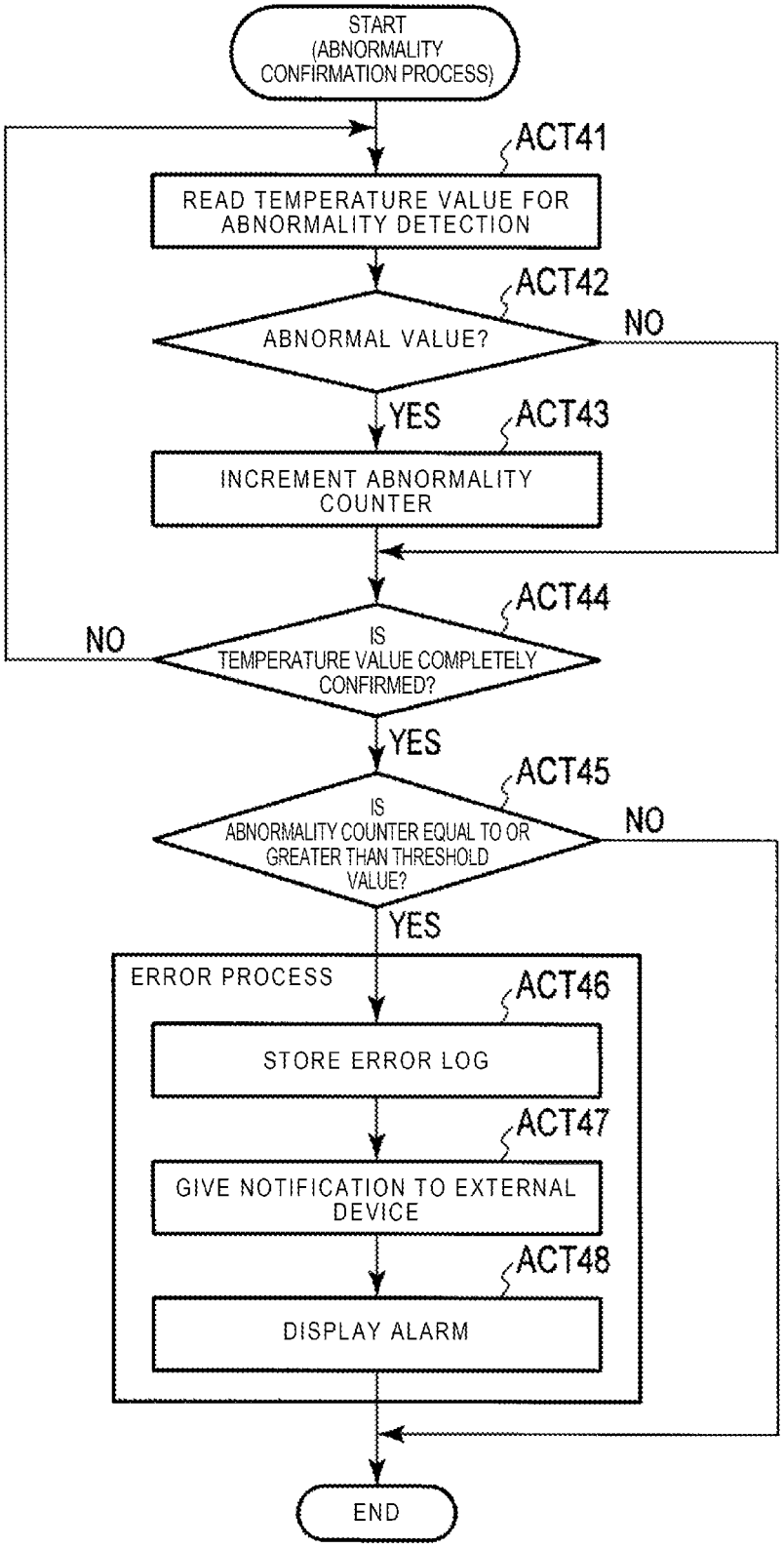
FIG. 12 is a flowchart for describing an operation example of an abnormality confirmation process for the fixing unit.

Here, the printer CPU 61 repeatedly performs the sampling process illustrated in FIG. 12 at a predetermined period (for example, 1 msec). The predetermined period for performing the sampling process at the temperature illustrated in FIG. 12 may be shorter than the sampling period for abnormality detection.

The printer CPU 61 updates a counter disposed in the RAM 62 at each predetermined period (ACT21). The counter records the elapsed time. For example, if the operation period is 1 msec, the printer CPU 61 increments a value of the counter every 1 msec. In this manner, the counter has a value indicating the elapsed time.

If the counter is updated, the printer CPU 61 determines whether or not the abnormality detection process is in progress (ACT22). For example, if the abnormality detection process is performed while the drive unit 41 is driven, the printer CPU 61 determines whether or not the drive unit 41 is driven. If it is determined that the abnormality detection process is in progress (ACT22, YES), the printer CPU 61 determines whether the current period is the sampling period for abnormality detection (ACT23).

When it is determined that the current period is the sampling period for abnormality detection (ACT23, YES), the printer CPU 61 acquires the information (temperature information) indicating the temperature measured by the temperature detector 35 (ACT24). If the temperature information is acquired, the printer CPU 61 stores the obtained temperature information in an abnormality detecting buffer (ACT25). The abnormality detecting buffer may be disposed in either the volatile memory such as the RAM 52 and the RAM 62 or the nonvolatile memory such as the NVM 54, the NVM 64, and the HDD 55. For example, if the sampled temperature information is stored all in the nonvolatile memory, there is a possibility that storage capacity may be insufficient. Accordingly, the sampled temperature information is stored in volatile memory. The nonvolatile memory may store the information (buffer content) stored in volatile memory when an error (to be described later) is detected, as a log at the time of error detection.

If the temperature information is stored in the abnormality detecting buffer, the printer CPU 61 determines whether or not to perform a process of confirming the presence or absence of abnormality (abnormality confirmation process) (ACT26). The abnormality confirmation process is performed at preset timing. For example, the abnormality confirmation process may be performed at an abnormality checking period (for example, every 50 msec) as a preset period.

When it is determined to perform the abnormality confirmation process (ACT26, YES), the printer CPU 61 performs the abnormality confirmation process, based on the temperature information stored in the abnormality detecting buffer (ACT27). The abnormality confirmation process will be described in detail later.

When it is determined that the current period is not the sampling period for abnormality detection (ACT23, NO), if it is determined that the abnormality confirmation process does not need to be performed (ACT26, NO) or if the abnormality confirmation process is performed (ACT26), the printer CPU 61 determines whether or not the current period is the sampling period for temperature control (ACT28).

When the current period is the sampling period for temperature control (ACT28, YES), the printer CPU 61 acquires the information (temperature information) indicating the temperature measured by the temperature detector 35 (ACT29). If the temperature information is acquired in the sampling period for temperature control, the printer CPU 61 stores the acquired temperature information in a temperature controlling buffer (ACT30). The temperature controlling buffer is disposed in the volatile memory such as the RAM 52 and the RAM 62. However, the temperature controlling buffer may be disposed in the nonvolatile memory such as the NVM 54, the NVM 64, and the HDD 55.

If the temperature information is stored in the temperature controlling buffer, the printer CPU 61 averages the temperature information items stored in the temperature controlling buffer for every predetermined number (for example, 5) of the temperature information items (a plurality of temperature information items measured in a predetermined time) (ACT31). The printer CPU 61 controls the temperature inside the fixing unit 29 by controlling the heating unit 33 to be turned on and off, based on the averaged temperature information.

According to the above-described process, when the abnormality detection process is in progress, separately from the temperature information for temperature control, the multi-functional peripheral acquires the temperature information for abnormality detection in the sampling period for abnormality detection. In addition, the multi-functional peripheral stores the temperature information acquired in the sampling period for abnormality detection in the abnormality detecting buffer. In this manner, the multi-functional peripheral can confirm the presence or absence of abnormality by using the temperature information stored in the abnormality detecting buffer.

Next, the abnormality confirmation process for the fixing unit 29 will be described.

FIG. 12 is a flowchart for describing an operation example of the abnormality confirmation process for the fixing unit 29.

When the abnormality confirmation process is performed, the printer CPU 61 reads one of the temperature information items (abnormality detecting temperature values) stored in the abnormality detecting buffer (ACT41). If the abnormality detecting temperature value is read, the printer CPU 61 determines whether the read temperature value is an abnormal value (ACT42). The printer CPU 61 compares the read temperature value with the value of the temperature control when the temperature value is measured, and determines whether or not the read temperature value is the abnormal value.

For example, the value compared with the read temperature value is a temperature value obtained by averaging the temperature values for temperature control in a period including the time during which the temperature value is measured. In this case, the printer CPU 61 specifies the temperature value obtained by averaging the temperature values for temperature control in the period including the time during which the temperature value is measured. The printer CPU 61 calculates a difference between the specified temperature value obtained through averaging and the temperature value, and determines whether or not the read temperature value is the abnormal value, based on whether or not the calculated difference exceeds an abnormality determining threshold value.

In addition, the value compared with the read temperature value may be the temperature value for temperature control measured before and after the temperature value is measured. In this case, the printer CPU 61 specifies the temperature value for temperature control measured before and after the temperature value is measured. The printer CPU 61 calculates a difference between the specified temperature value for temperature control and the temperature value, and determines whether or not the read temperature value is the abnormal value, based on whether or not the calculated difference exceeds the abnormality determining threshold value.

In addition, the value compared with the read temperature value may be a temperature value (fixing temperature) of a control target in the temperature control when the temperature value is measured. In this case, the printer CPU 61 specifies the temperature value of the control target in the temperature control when the temperature value is measured. The printer CPU 61 calculates a difference between the temperature value of the control target in the temperature control and the temperature value, and determines whether or not the read temperature value is the abnormal value, based on whether or not the calculated difference exceeds an abnormality determining threshold value.

For example, FIG. 13 is a view illustrating an example of the abnormality detecting temperature value stored in the abnormality detecting buffer.

In FIG. 13, the sampling period for abnormality detection is set to 5 msec, and the sampling period for temperature control is set to 50 msec. In this case, in one period of the sampling period (50 msec) for temperature control, 10 temperature values are measured in the sampling period (5 msec) for abnormality detection.

In the example illustrated in FIG. 13, the temperature value (temperature value obtained through averaging) for temperature control which is measured in the sampling period for temperature control is set to 151° C. In this case, the printer CPU 61 determines whether or not the read temperature value is the abnormal value, based on a difference between each temperature value for abnormality detection and 151° C. serving as the temperature value for temperature control. If the threshold value for abnormality determination with respect to the difference is 10° C., it is determined that the temperature values 165° C. and 136° C. illustrated in FIG. 13 are the abnormal values.

When it is determined that the read temperature value is the abnormal value (ACT42, YES), the printer CPU 61 increments the abnormality counter (ACT43). For example, the abnormality counter is disposed in the RAM 62. In addition, the abnormality counter may be disposed in the NVM 63, or may be disposed in the RAM 52, the NVM 54, or the HDD 55.

The printer CPU 61 performs the processes in ACT41 to ACT43 for each temperature value until it is completely determined whether or not each temperature value stored in the abnormality detecting buffer is the abnormal value (ACT44, NO). If the printer CPU 61 completely confirms whether or not each temperature value stored in the abnormality detecting buffer is the abnormal value (ACT44, YES), the printer CPU 61 determines whether the value of the abnormality counter is a value regarded as an error (ACT45).

For example, the printer CPU 61 determines whether the value of the abnormality counter (the number of times that the abnormal value is detected) is equal to or greater than an error determining threshold value (the predetermined number of times that the value is regarded as the error). There is a possibility that the output of the temperature detector 35 may actually include noise due to implementation. Therefore, there is a possibility that the temperature value determined as the abnormal value is caused by the noise. Therefore, by determining that the temperature value is an error when the number of times that the abnormal value is detected is equal to or more than the predetermined number of times, the influence of the noise in the temperature detector 35 can be reduced.

When it is determined that the value of the abnormality counter is equal to or greater than the error determining threshold value (the predetermined number of times) (ACT45, YES), the printer CPU 61 performs an error process (ACT46 to ACT48). The content of the error process performed when an error is detected in the temperature of the fixing unit 29 can be appropriately set depending on an operation mode.

For example, as the error process, the printer CPU 61 stores the temperature information determined as the error, in the NVM 63 as an error log (ACT46). The information as the error log of the temperature information determined as the error may be stored in the NVM 54 or the HDD 55 of the system control unit 5.

In addition, as the error process, the printer CPU 61 causes the display unit 4*a* of the operation panel 4 to display that the abnormal value is detected in the temperature of the fixing unit 29 (ACT48). In this case, the printer CPU 61 may cause the display unit 4*a* to display that there is a possibility of poor connection of the fixing unit 29 (poor coupling of the harness). In addition, when the display unit 4*a* displays that abnormality is detected, the printer CPU 61 may cause the display unit 4*a* to display the temperature information stored in the abnormality detecting buffer.

In addition, as the error process, the printer CPU 61 notifies an external device (for example, a management server) that the abnormal value is detected in the temperature of the fixing unit 29 (ACT47). In this case, the printer CPU 61 notifies the management server that the abnormality is detected, via the external interface 58 of the system control unit 5. In addition, the printer CPU 61 may notify the external device that there is a possibility of poor connection of the fixing unit 29. In addition, when the printer CPU 61 gives notification of the fact that abnormality is detected, the printer CPU 61 may transmit the information such as the temperature information stored in the abnormality detecting buffer to the external device.

The above-described process is not limited to detecting abnormality of the fixing unit 29 during the operation of the multi-functional peripheral. For example, the multi-functional peripheral may perform the above-described process in a mode (initial abnormality check mode) when the multi-functional peripheral is manufactured and assembled after the fixing unit 29 is attached thereto. In this manner, the multi-functional peripheral can detect initial abnormality caused by poor attachment of the fixing unit 29 when the multi-functional peripheral is assembled as a product (manufacturing process including the attachment of the fixing unit 29).

Furthermore, as the error process in the mode when the multi-functional peripheral is manufactured and assembled, the multi-functional peripheral may not store the error log or may not notify the external device of the error log, but may cause the display unit 4*a* to display the abnormality. In this manner, when the multi-functional peripheral is manufactured and assembled, the worker can easily recognize the abnormality caused by poor attachment of the fixing unit 29, based on the display content of the display unit 4*a*.

As the error process in the operation mode (operation mode other than the mode when the multi-functional peripheral is manufactured and assembled) when the multi-functional peripheral is operated by a user, the multi-functional peripheral may not cause the display unit 4*a* to display the abnormality, but store the error log, or notify the external device of the error log. In this manner, when the multi-functional peripheral is operated by the user, the multi-functional peripheral may not positively notify the user that there is a possibility of abnormality (possibility of abnormality for which the actual fixing process does not need to be immediately stopped), but a serviceman or the management server can efficiently perform maintenance on the poor attachment of the fixing unit 29.

As described above, the multi-functional peripheral according to the embodiment can easily determine the possibility of abnormality which is less likely to be found in the temperature measurement in the normal fixing process. As a result, it is possible to detect the abnormality of the fixing unit 29 at an early stage even when the product is assembled or is operated by the user, and problems caused by breakage of a fixing unit can be prevented in advance. In addition, the temperature information measured in the period shorter than that of the normal temperature measurement is stored as the error log, or notification of the error log is given to the external device. In this manner, it is possible to easily analyze problems in the case where the problems actually occur.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A fixing unit comprising:

a heater that generates heat;

a fixing member that is heated by the heat generated by the heater;

a press roller that forms between the press roller and the fixing member a nip portion through which a medium having a fixing target material transferred thereto passes;

a sensor that measures a temperature of the fixing member;

a processor that acquires the temperature detected by the sensor in a first time period, controls the temperature of the fixing member so as to be a target value, and acquires the temperature detected by the sensor in a second time period shorter than the first time period; and a memory that records the temperature acquired in the second time period.

2. The fixing unit according to claim 1, further comprising:

a contact and separation mechanism that causes the fixing member and the press roller to come into contact with or to separate from each other, wherein the processor acquires the temperature detected by the sensor in the second time period while the contact and separation mechanism is driven in order to control the nip portion.

3. The fixing unit according to claim 1, wherein the processor determines whether or not the temperature acquired in the second time period is an abnormal value, and outputs a signal notifying if the abnormal value occurs.

4. The fixing unit according to claim 3, wherein the processor outputs the signal notifying that the abnormal value occurs, when the number of times when a difference between the temperature acquired in the second time period and an average value of the temperatures acquired in the first time period is equal to or greater than a predetermined threshold value is equal to or more than a predetermined number of times.

5. The fixing unit according to claim 1, wherein the heater is an electromagnetic induction heater or a halogen lamp heater.

6. The fixing unit according to claim 1,
wherein the second time period is half as short or shorter than the first time period.

7. The fixing unit according to claim 1,
wherein the second time period is a tenth as short or shorter than the first time period.

8. An image forming apparatus comprising:
an image forming unit configured to form an image by using an image forming material;
a heater that generates heat;
a fixing member that is heated by the heat generated by the heater;
a press roller that forms between the press roller and the fixing member a nip portion through which a medium having a transferred image formed of the image forming material passes;
a sensor that measures a temperature of the fixing member;
a processor that controls the temperature of the fixing member so as to be a target value by acquiring the temperature detected by the sensor in a first time period, and also acquires the temperature detected by the sensor in a second time period shorter than the first time period; and
a memory that records the temperature acquired in the second time period.

9. The apparatus according to claim 8, further comprising:
a contact and separation mechanism that causes the fixing member and the press roller to come into contact with or to separate from each other,
wherein the processor acquires the temperature detected by the sensor in the second time period while the contact and separation mechanism is driven.

10. The apparatus according to claim 8,
wherein when the processor determines that the temperature acquired in the second time period is an abnormal value, the processor outputs a signal notifying if the abnormal value occurs.

11. The apparatus according to claim 10,
wherein when the number of times when a difference between the temperature acquired in the second time period and an average value of the temperatures acquired in the first time period is equal to or greater than a predetermined threshold value is equal to or more than a predetermined number of times, the processor determines that the temperature acquired in the second time period is the abnormal value.

12. The apparatus according to claim 10, further comprising:
a display unit for displaying that the abnormal value occurs, in accordance with the signal output by the processor.

13. The apparatus according to claim 10, further comprising:
a communication interface that communicates with an external device,
wherein when the processor determines that the temperature acquired in the second time period is the abnormal value, the processor transmits the signal notifying if the abnormal value occurs, to the external device.

14. The apparatus according to claim 8,
wherein the second time period is half as short or shorter than the first time period.

15. A fixing method comprising:
generating heat to heat a fixing member;
a press roller that forms between the press roller and the fixing member a nip portion through which a medium having a fixing target material transferred thereto passes;
measuring a temperature of the fixing member;
acquiring the temperature measured in a first time period;
controlling the temperature of the fixing member so as to be a target value; and
acquiring the temperature measured in a second time period shorter than the first time period; and
recording the temperature acquired in the second time period.

16. The method according to claim 15, further comprising:
causing the fixing member and a press roller to come into contact with or to separate from each other; and
acquiring the temperature measured in the second time period while causing the fixing member and a press roller to come into contact with or to separate from each other in order to control a nip portion.

17. The method according to claim 15, further comprising:
determining whether or not the temperature acquired in the second time period is an abnormal value, and outputting a signal notifying if the abnormal value occurs.

18. The method according to claim 17,
outputting the signal notifying that the abnormal value occurs, when the number of times when a difference between the temperature acquired in the second time period and an average value of the temperatures acquired in the first time period is equal to or greater than a predetermined threshold value is equal to or more than a predetermined number of times.

19. The method according to claim 15,
wherein heating is carried out with an electromagnetic induction heater or a halogen lamp heater.

20. The method according to claim 15,
wherein the second time period is half as short or shorter than the first time period.

* * * * *